US008950346B2

(12) United States Patent
Schinasi

(10) Patent No.: US 8,950,346 B2
(45) Date of Patent: Feb. 10, 2015

(54) METHOD FOR PRODUCTION OF BAGS FOR THE TRANSPORT AND STORAGE OF BULK GOODS, AND BAG OBTAINED ACCORDING TO THE METHOD

(75) Inventor: Piero Schinasi, Epalinges (CH)

(73) Assignee: Codefine S.A., Lausanne (CH)

( * ) Notice: Subject to any disclaimer, the term of this patent is extended or adjusted under 35 U.S.C. 154(b) by 880 days.

(21) Appl. No.: 13/138,024

(22) PCT Filed: Dec. 22, 2009

(86) PCT No.: PCT/IB2009/055911

§ 371 (c)(1),
(2), (4) Date: Jun. 24, 2011

(87) PCT Pub. No.: WO2010/073219

PCT Pub. Date: Jul. 1, 2010

(65) Prior Publication Data

US 2011/0268375 A1 Nov. 3, 2011

(30) Foreign Application Priority Data

Dec. 24, 2008 (CH) ..... 2016/08

(51) Int. Cl.

| | |
|---|---|
| ***D05B 13/00*** | (2006.01) |
| *B32B 7/08* | (2006.01) |
| *B65D 88/16* | (2006.01) |
| *B65D 90/46* | (2006.01) |

(52) U.S. Cl.

CPC ..... *D05B 13/00* (2013.01); *B65D 88/16* (2013.01); *B65D 90/46* (2013.01)

USPC ..... 112/475.08; 112/11; 112/440; 383/107

(58) Field of Classification Search

CPC ..... D05B 13/00; D05B 13/02; D05B 1/12; D05B 93/00

USPC ..... 112/10, 11, 163, 475.08, 475.17; 383/107

See application file for complete search history.

(56) References Cited

U.S. PATENT DOCUMENTS

| | | | | |
|---|---|---|---|---|
| 1,524,190 | A * | 1/1925 | McNeil | 112/10 |
| 1,699,423 | A * | 1/1929 | Brase | 112/475.17 |
| 3,109,394 | A * | 11/1963 | Golden | 112/10 |
| 6,962,120 | B1 * | 11/2005 | Fujikura et al. | 112/475.17 |
| 2010/0326341 | A1 * | 12/2010 | Mingazhev et al. | 112/166 |
| 2011/0041745 | A1 * | 2/2011 | Mingazhev et al. | 112/475.17 |
| 2013/0081563 | A1 * | 4/2013 | Asao et al. | 112/166 |

FOREIGN PATENT DOCUMENTS

| | | | |
|---|---|---|---|
| DE | 531 448 | C | 8/1931 |
| EP | 0 720 956 | A1 | 7/1996 |
| GB | 2 297 288 | A | 7/1996 |
| GB | 2 301 087 | A | 11/1996 |

(Continued)

*Primary Examiner* — Ismael Izaguirre
(74) *Attorney, Agent, or Firm* — Krieg DeVault LLP

(57) ABSTRACT

The invention comprises using a fabric cut into several pieces which are further assembled together by stitches, the stitches being made using a sewing machine comprising at least two needles (A', B') operating in-line one behind the other so that the sewing stitch of the second needle (B') is made on the threads of the sewing stitch made by the first needle (A') in order to cover the perforation made by the first needle and so that the perforation made by the second needle (B') is made through said thread (11), thereby filling said perforation with said thread (11).

8 Claims, 3 Drawing Sheets

(56) References Cited

FOREIGN PATENT DOCUMENTS

| | | | |
|---|---|---|---|
| JP | 2004 033548 | A | 2/2004 |
| JP | 2005 118400 | A | 5/2005 |
| WO | WO 2009/063795 | A1 | 5/2009 |
| WO | WO 2009/113337 | A1 | 9/2009 |

* cited by examiner

METHOD FOR PRODUCTION OF BAGS FOR THE TRANSPORT AND STORAGE OF BULK GOODS, AND BAG OBTAINED ACCORDING TO THE METHOD

This application claims the benefits under 35 U.S.C. 119 (a)-(d) or (b), or 365(b) of International Application No. PCT/IB2009/055911 filed 22 Dec. 2009, and Swiss Patent Application No. 02016/08 filed 24 Dec. 2008.

TECHNICAL FIELD

The present invention relates to a method for production of bags for the transport and storage of bulk goods, as well as the bag obtained according to the method.

STATE OF THE ART

Bags for the transport and storage of bulk goods, which are also known as "big bags", are in general made of fabrics woven from polypropylene, which fabrics may or may not be laminated. The most common method for production of bags of this type consists of sewing together a plurality of pieces of fabric, so as to form a rectangular parallelepiped.

For this purpose, it is possible to use fabrics which are produced by means of a flat loom. However, flat looms are machines which are relatively rigid in their conditions of use, and costly, which involves a high cost price of the fabric. This is why, for slightly more than the last ten years, it has been proposed to make bags using tubular fabrics produced by means of so-called circular looms, which are less expensive than the flat looms, the pieces which are designed to be sewn together to form the bag being constituted by sections of tubular fabric which are flattened so as to form lengths of flat double-thickness fabric, the width of which is half the circumference of the tube. A first advantage of the use of a double fabric is that this makes it possible to use a fabric weighing 75 to 125 grams per square meter, whereas otherwise a piece of single fabric weighing 150 to 250 grams per square meter would have been used. This constitutes an obvious economic advantage since, in general, the production of the same tonnage of fabric of x grams per square meter is cheaper than that of the same tonnage of fabric of 2x grams per square meter. Another important advantage derived from the use of a double fabric is that the double fabric makes it possible to reduce substantially the risks of tearing or piercing of the bag, particularly in the case of abrasion, the double fabric being more resistant to friction and snagging than a single fabric. Indeed, on the assumption that the outer thickness is damaged in one place, the inner thickness continues to be able to support by itself the entire load (in this respect it should be specified that the safety coefficient which must be respected for big bags is 5 to 1).

Since pieces of fabric are to be sewn together to form the bag, use is generally made of sewing machines with one needle or two needles. In the case of machines with two needles, the needles work in parallel, generally at a distance of approximately 0.5 to 1 cm, in order to produce two parallel seams which increase the strength of the assembly. An example of a machine of this type is represented schematically in FIG. 3.

Big bags are used for the storage, handling and transport of various goods, with nominal weights of approximately 250 to 3,000 kilos. These goods are often in the form of powders which are more or less fine.

As a result of the perforation of the pieces of fabric when they are sewn in order to form the bag, there is a risk of the powder escaping via the sewing holes, even in the case of laminated fabrics. In order to eliminate this disadvantage, hitherto various means or methods have been used, such as, for example, insertion inside the bag of a sheath constituted by a film made of polyethylene or another plastic material, or use of special fibrous sewing threads of the "floss" type, combined with the conventional sewing threads, or the application of felt to the seams. However, none of these solutions has proved to be fully satisfactory. The insertion of a sheath inside the bag is a delicate additional operation. Furthermore, the sheath slows down the filling of the bag, and is in danger of blocking the filling if its insertion in the bag is not perfect. In addition, the sheath is liable to pollute the goods contained in the bag when the bag is emptied. Finally, according to the nature of the powders to be transported, the polyethylene sheaths can be costly, which increases substantially the cost of production of the bag. Also, the aforementioned combinations of threads are imperfect solutions which do not guarantee sufficient sealing for very fine powders. Moreover, because of their fibrous nature, these threads are liable to pollute the content of the bag, and constitute a major risk of contamination.

DISCLOSURE OF THE INVENTION

The object of the present invention is to propose a method for production of bags for the transport and storage of bulk goods, which makes it possible to overcome the above-described disadvantages, and in particular to provide virtually perfect sealing against the powders, without the insertion of a sheath in the bag, and without resorting to threads of the floss type, or to the addition of felt.

For this purpose, the present invention relates to a method for production of bags for the transport and storage of bulk goods wherein use is made of fabric cut into several pieces, which are then assembled to one another by means of seams, characterised in that the seams are made by means of a sewing machine comprising at least two needles working in-line one behind the other, such that the stitch of the second needle is made on the thread of the stitch made by the first needle, such as to cover the perforation produced by the first needle, and such that the perforation produced by the second needle is made through the said thread, thus filling the said perforation with the said thread.

It also relates to a bag for the transport and storage of bulk goods obtained according to this method, and a sewing machine for implementation of the method, characterised in that it comprises at least two needles which are designed to work one behind the other, and alternately.

Other important characteristics of the invention form the basis of the dependent claims, and are discussed hereinafter.

BRIEF DESCRIPTION OF THE DRAWINGS

The following description is provided by way of non-limiting example. It relates to the drawing, in which.

DETAILED DESCRIPTION OF THE EMBODIMENTS OF THE INVENTION

The bags according to the invention are preferably made of pieces constituted by sections of tubular fabric flattened so as to form lengths of flat double-thickness fabric, the width of which is half the circumference of the tube. Pieces of fabric of this type are for example represented in FIGS. 1 and 2.

Figure 1:
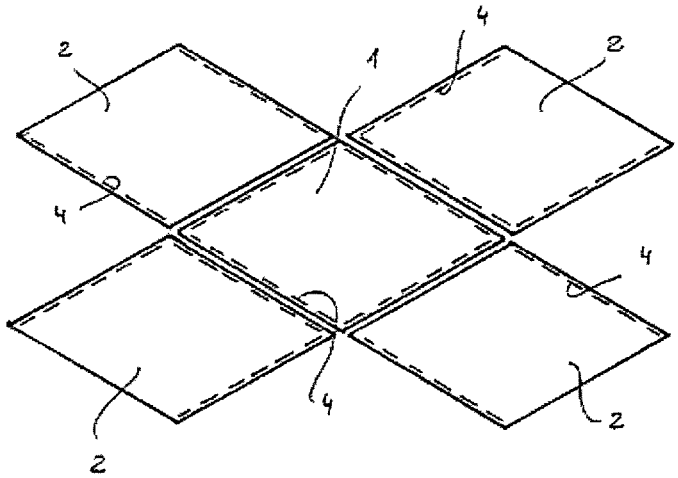
FIG. 1 is a perspective view of a schematic example of five pieces of fabric which are designed to be sewn to one another in order to form a bag according to the invention.

FIG. 1 shows a first piece 1 which will act as the bottom of the bag, as well as four lateral pieces 2, which can be square or rectangular, and one of the dimensions of which is equal to one of the sides of the piece 1. The pieces 1 and 2 are shown as they are to be assembled, with their assembly being carried out by sewing, as will be described hereinafter, along virtual lines 4, which are represented in broken lines in FIG. 1, parallel to the sides of the pieces 1 and 2.

Figure 2:
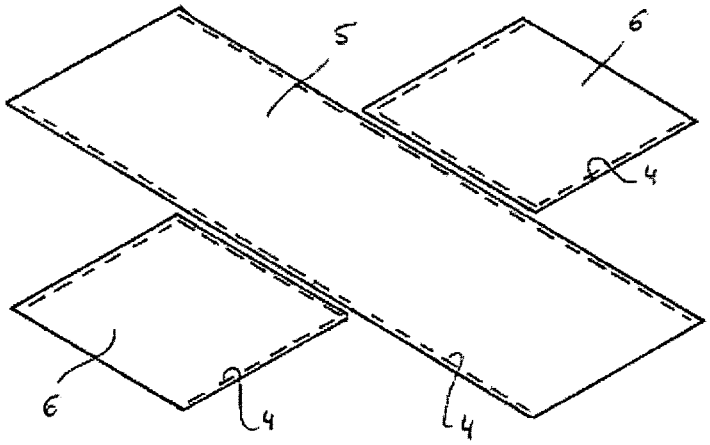
FIG. 2 is a perspective view of a schematic example of three pieces of fabric which are designed to be sewn to one another, in order to form a bag according to the invention.

The example represented in FIG. 2 shows a first piece 5 which is designed to constitute both the bottom of the bag and two opposite lateral walls, and two complementary pieces 6 which are designed to constitute the two other lateral walls of the bag. It will be appreciated that numerous other combinations of pieces are possible for the production of a bag according to the invention.

Figure 3:
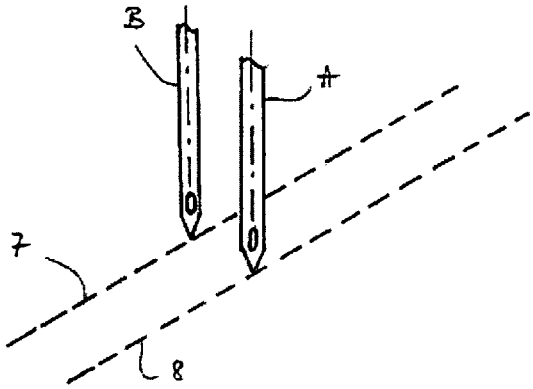
FIG. 3 is a partial schematic perspective view of a conventional sewing machine with two needles working in parallel.

The essential concept of the production method according to the invention consists of carrying out the sewing of the pieces of fabric to one another with a sewing machine with two needles, but wherein the two needles no longer work in parallel, but one behind the other. An example of a machine of this type is represented schematically in FIG. 4. A machine of this type can be formed by modifying a conventional machine of the type represented in FIG. 3. As previously stated, with the machine in FIG. 3, the two needles A and B work in parallel, generally at a distance of 0.5 to 1 cm, such as to form two parallel seams 7 and 8. The modification is consequently obtained by pivoting the support for the needles by 90° and adapting the machine, such that, after modification of the machine, the two needles A', B' work one behind the other in the direction 10, at equivalent stitch distances, but alternately and no longer simultaneously, to form a seam along a single line 9. The second needle perforates the fabric in the middle of the stitch made by the first needle, so as to cover both the stitch and the perforation by the first needle, as will be described in greater detail hereinafter.

Figure 5:
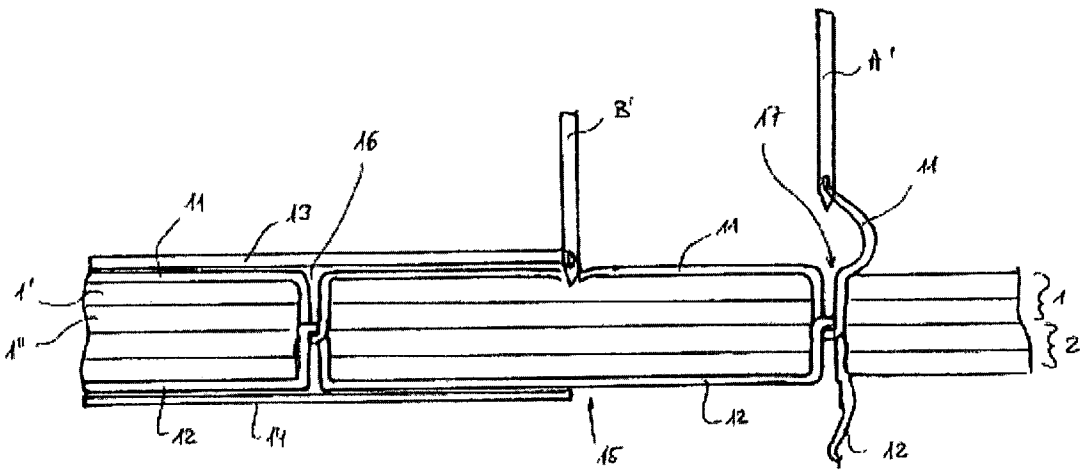
FIG. 5 is a schematic view in vertical cross-section along a seam which is designed to assemble two pieces of fabric for the formation of a bag according to the invention.

The production of the seam for the formation of a bag according to the invention will be better understood if reference is made to FIG. 5.

Figure 4:
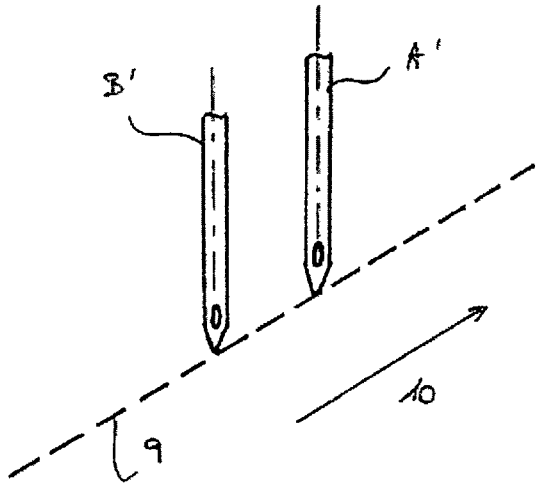
FIG. 4 is a partial schematic perspective view of a sewing machine with two needles according to the invention, with the two needles being arranged to work in sequence, one behind the other.

FIG. 5 shows the state of advance of a seam 9 by means of the needles A' and B' in FIG. 4, for the assembly of two pieces of fabric 1 and 2, such as those represented for example in FIG. 1. The needle A' produces stitches using two threads 11 and 12, whereas the needle B' uses two threads 13 and 14. At the stage of advance of the seam represented in FIG. 5, the first needle A' has finished producing the stitch 15, after having perforated the fabrics in the position 17. At this moment, the second needle B' is put into action and its perforation is produced through the thread 11, which constitutes the stitch 15 by the first needle. The said perforation produced by the second needle B' is thus filled by the thread 11 of the stitch 15 made by the first needle A'. Moreover, the thread 13 covers the stitch 15, as well as, of course, the preceding stitch, both made by the needle A'. Consequently, the thread 13 also covers the preceding perforation 16 by the first needle A'. In addition, because of the use of pieces of fabric 1 and 2 with a double thickness, the seam is produced through the two thicknesses of fabric. At the moment when the seam is made, the outer fabric 1' slides slightly relative to the inner fabric 1", thus contributing towards obstruction of the perforation in the seam.

The bags made in accordance with the method of the invention have a level of sealing which is far greater than the conventional bags. This degree of sealing can also be improved by using for the seam multi-filament threads with a textured structure, and which in particular have elongation of 30 to 35%.

The bags according to the invention can advantageously be made from flattened tubular pieces of fabric comprising conductive threads.

The invention claimed is:

1. Method for production of bags for the transport and storage of bulk goods comprising the steps of providing fabric, cutting the fabric into several pieces and assembling them one to another, wherein the step of assembling comprises the steps of providing a sewing machine equipped with at least two needles, feeding each needle with a thread and operating said needles in-line one behind the other in one and the same direction so as to produce a seam along a single line through the thicknesses of the pieces of fabric with a stitch formed by the second needle being made on the thread of a stitch formed by the first needle, the stitch formed by the second needle covering a perforation produced by the first needle, and a perforation produced by the second needle being thus made through the thread, thereby filling the perforation with the thread.

2. Method according to claim 1, further comprising, when the fabric is tubular, performing a preliminary step of flattening the fabric so as to form a double-thickness fabric.

3. Method according to claim 1, wherein the step of assembling comprises the step of controlling the needles such that the needles work alternately, and at equivalent stitch distances.

4. Method according to claim 1, wherein the second needle perforates the fabric in the middle of the stitch of the first needle.

5. Method according to claim 1, wherein the threads fed into the needles of the sewing machine comprise multi-filament threads with a textured structure.

6. Bag for the transport and storage of bulk goods obtained according to the method of claim 1.

7. Bag according to claim 6, made from flattened tubular pieces of fabric comprising conductive threads.

8. Sewing machine for implementation of the method according to claim 1, comprising at least two needles which are arranged to work one behind the other and alternately.

* * * * *